United States Patent [19]

Turner

[11] 4,174,041

[45] Nov. 13, 1979

[54] RECLOSABLE DISPENSING CARTON

[75] Inventor: Gerald W. Turner, Norristown, Pa.

[73] Assignee: Container Corporation of America, Chicago, Ill.

[21] Appl. No.: 943,323

[22] Filed: Sep. 18, 1978

[51] Int. Cl.[2] ..... B65D 5/54; B65D 17/20

[52] U.S. Cl. ..... 206/611; 206/626; 229/40; 229/44 R

[58] Field of Search ..... 206/610, 611, 626; 229/40, 44 R

[56] References Cited

U.S. PATENT DOCUMENTS

| | | | |
|---|---|---|---|
| 2,964,228 | 12/1960 | Cote et al. | 229/44 R |
| 3,114,492 | 12/1963 | Engstrom | 229/40 |
| 3,295,741 | 1/1967 | Meyers | 229/40 |
| 3,333,690 | 8/1967 | Marsh | 206/806 |
| 3,366,310 | 1/1968 | Simpson et al. | 206/626 |
| 3,368,738 | 2/1968 | Roccaforte et al. | 206/626 |
| 3,635,392 | 1/1972 | Burgher | 206/611 |

*Primary Examiner*—Stephen P. Garbe

*Attorney, Agent, or Firm*—Carpenter & Ostis

[57] ABSTRACT

An end opening, reclosable tubular dispensing carton.

2 Claims, 6 Drawing Figures

RECLOSABLE DISPENSING CARTON

SUMMARY OF THE INVENTION

This invention relates to dispensing containers and more particularly to an end opening, reclosable tubular dispensing carton formed of a unitary blank of foldable paperboard.

It is an object of the invention to provide a folder type container having a novel end closure arrangement which may be easily opened and reclosed for dispensing packaged articles such as sheets of paper.

Another object of the invention is the provision of a container of the type described which will accommodate a variation of materials or product thickness.

These and other objects of the invention will be apparent from an examination of the following description and drawings.

THE DRAWINGS

It will be understood that, for purposes of clarity, certain elements may have been intentionally omitted from certain views where are believed to be illustrated to better advantage in other views.

THE DESCRIPTION

Figure 6:
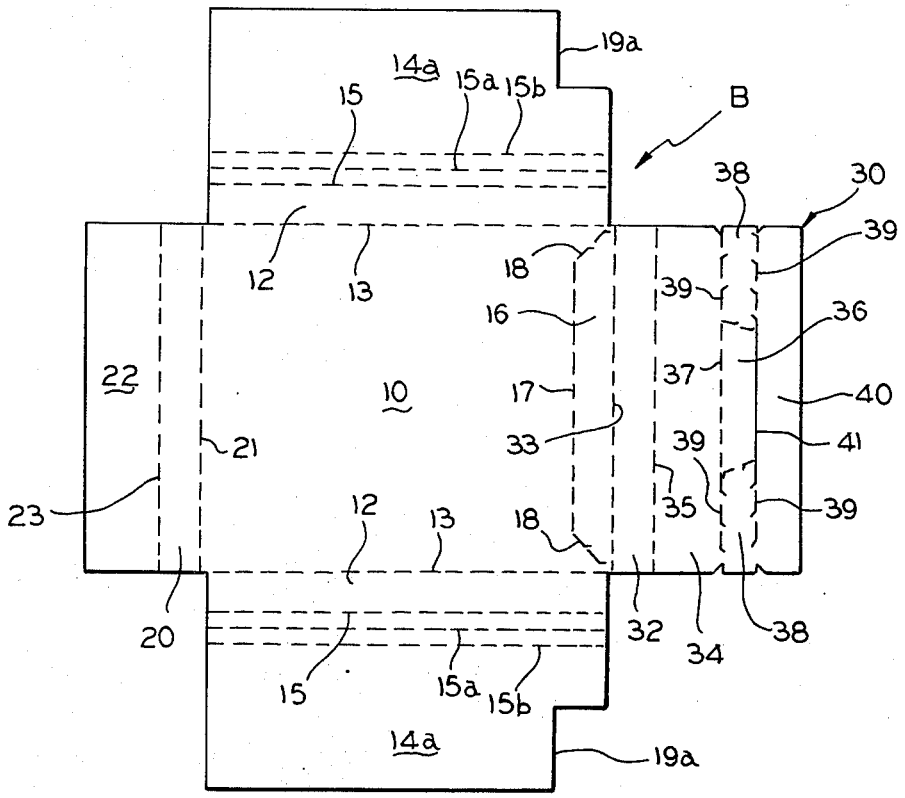
FIG. 6 is a plan view of the blank from which the container illustrated in the other views may be formed.
Figure 2:
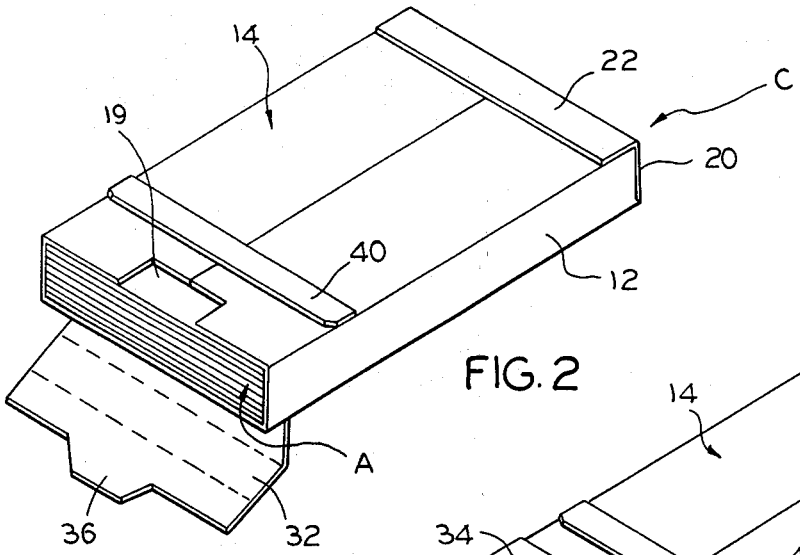
FIG. 2 is a view similar to FIG. 1 but with the container shown in the opened position for dispensing.
Figure 4:
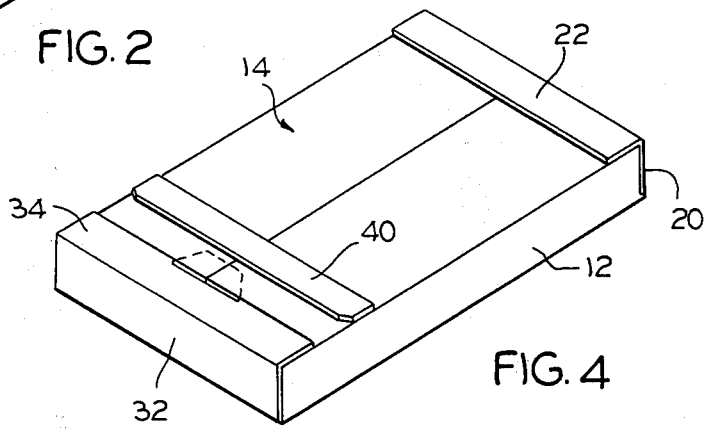
FIG. 4 is a view similar to FIGS. 1 and 2 but with the container shown in the reclosed position.

Referring now to the drawings for a better understanding of the invention, it will be seen that the container C illustrated in FIG. 2 which is adapted to hold a plurality of articles A, may be formed from the unitary blank B of foldable sheet material illustrated in FIG. 6.

Referring now to FIGS. 2 and 6, it will be seen that the container C includes a preferably rectangular, bottom wall 10 having a pair of side walls 12 foldably joined on fold lines 13 to opposite side edges thereof. The container also includes a top wall 14 which is comprised of a pair of generally similar, co-planar top wall panels **14*a* which are joined at their outer edges along fold lines 15 to the upper edges of side walls 12**.

If desired, panels 14 may be provided with additional sets of fold lines such as **15*a* and 15*b* which accommodates a variation of material or product thickness. Thus the top wall panels 14*a* may be folded on the appropriate score lines depending on the height of the article or articles in the container. At one end of the container there is provided a relatively narrow hinge panel 16 which is formed from material of bottom wall 10 and which is joined to bottom wall 10 along a fold line 17 and a pair of weakened lines of tear 18 which permit the hinge panel to be partially detached from bottom wall 10 and folded downwardly therefrom as illustrated in FIG. 2. At the opposite end of the container there is provided a conventional closure means which includes an end panel 20 foldably joined on fold line 21 to an end edge of bottom wall 10 and a glue flap 22 foldably joined along one edge on fold line 23 to the other edge of end panel 20. As best seen in FIG. 2, glue flap 22 may be secured to the upper surface of top wall 14**.

At the first mentioned end of the container there is provided a novel closure structure 30 which accommodates the easy opening and reclosure.

Figure 1:
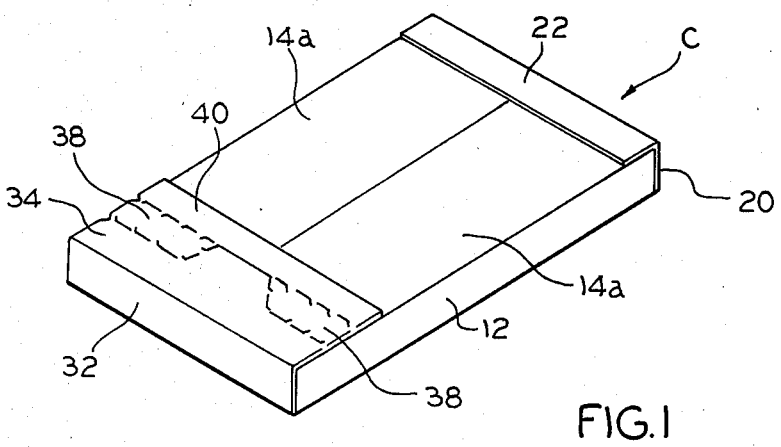
FIG. 1 is a perspective view of a container embodying features of the invention, as seen in the closed condition.

Structure 30 includes an end panel 32 foldably joined at its lower edge on fold line 33 to the forward edge of hinge panel 16; a reclosure panel 34 foldably joined at its outer edge on fold line 35 to the upper edge of end panel 32; a detachable tear strip 38 which is defined by a pair of weakened lines of tear 39; and a securing panel 40 adapted to be secured to the upper surface of top wall 14. As best seen in FIGS. 1, 2 and 6, weakened lines of tear 39 serve to connect the reclosure panel 34 to the securing panel 40, and also define a lock tab 36 which is integral with and projects inwardly from reclosure panel 34.

Figure 3:
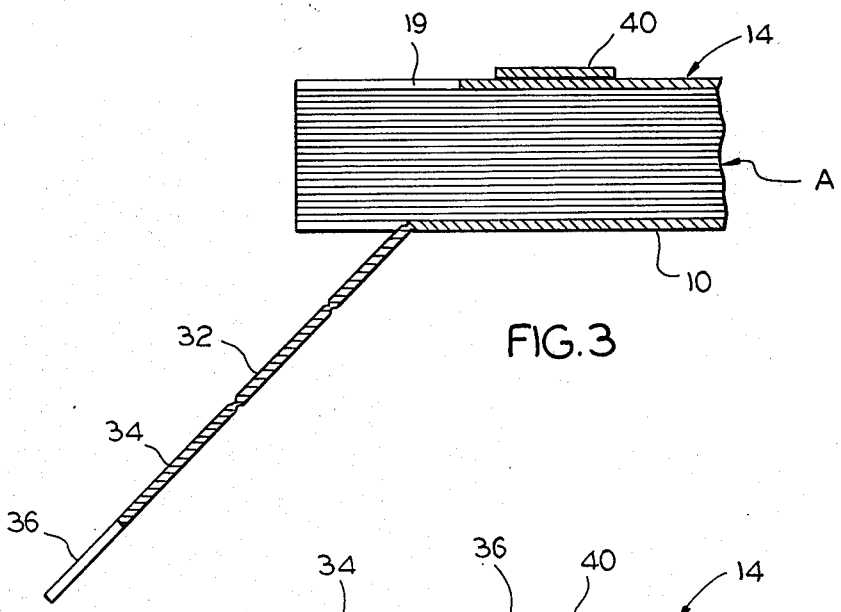
FIG. 3 is a fragmentary, longitudinal, vertical section of the structure illustrated in FIG. 2.
Figure 5:
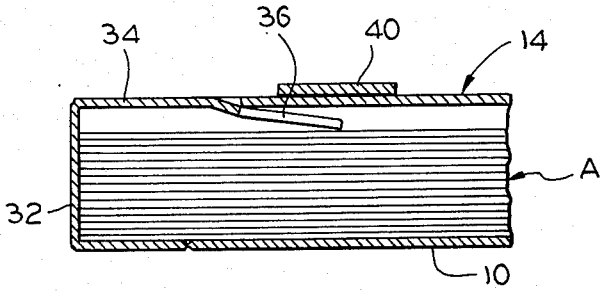
FIG. 5 is a fragmentary, vertical, longitudinal section of the structure illustrated in FIG. 4.

In order to open the container, the tear strip 38 is detached along weakened lines 39 so that the reclosure panel 34, the end panel 32, and the hinge panel 16 can be folded downwardly as shown in FIG. 3 to provide access to the articles packaged in the container. It will be noted that at its outer edge, lock tab 36 is separated from securing panel 40 by a cut line 41 which is aligned with one of the weakened lines of tear 39. To reclose the dispensing container, the hinge panel 16, end panel 32, and reclosure panel 34 are folded back into the original position. To lock the carton in closed position, lock tab 36 is inserted under the edge of top wall 14 and is received within a recess 19 in the top wall, which recess is defined by a pair of adjacent recesses **19*a* in the top wall panels 14*a***.

Thus it will be appreciated that the novel structure provides an easy opening structure which affords accessibility for dispensing and which may be readily reclosed and locked in the closed position.

I claim:

1. An end-opening, reclosable, tubular dispensing container formed of a unitary blank of foldable sheet material, for holding and shipping packaged articles such as sheets of paper or the like, comprising:

(a) a bottom wall, a top wall formed from a pair of panels, and a pair of side walls foldably joined to form a tubular body open at the ends;

(b) an integral, reclosable, dispensing end closure structure at one end of said body including:

(i) an at least partially separable hinge panel cut from material of said bottom wall and detachably joined to a forward edge thereof along a fold line and a pair of diagonally disposed weakened lines of tear diverging from the ends of said fold line toward said end closure structure;

(ii) an end panel foldably joined to said hinge panel;

(iii) a reclosure panel foldably joined at its outer side edge to said end panel and having a locking tab projecting from its inner side edge;

(iv) a securing panel attached to the outer surface of the top wall of said body for retaining said walls together and thereby forming said tubular body;

(v) a removable strip interposed between said reclosure and securing panels and detachably secured to each by parallel tear lines and defining said locking tab;

(vi) said top wall presenting an opening adjacent said one end of the body for receiving said locking tab after initial opening and reclosure of said container.

2. A container according to claim 1, wherein said top wall opening is formed by aligned recesses in said top wall panels.

* * * * *